United States Patent [19]

Högfeldt, deceased

[11] Patent Number: 4,572,943

[45] Date of Patent: Feb. 25, 1986

[54] ELECTRICAL STEAM GENERATOR FOR INTERMITTENT OPERATION

[75] Inventor: Carl-Erik Högfeldt, deceased, late of Stockholm, Sweden, by Birgitta Högfeldt, administrator

[73] Assignee: Acela Pump AB, Stockholm, Sweden

[21] Appl. No.: 552,125

[22] PCT Filed: Feb. 21, 1983

[86] PCT No.: PCT/SE83/00059

§ 371 Date: Oct. 19, 1983

§ 102(e) Date: Oct. 19, 1983

[87] PCT Pub. No.: WO83/02992

PCT Pub. Date: Sep. 1, 1983

[30] Foreign Application Priority Data

Feb. 22, 1982 [SE] Sweden ..... 8201103

[51] Int. Cl.[4] ..... F22B 27/16; F22B 1/28; H05B 3/00

[52] U.S. Cl. ..... 219/273; 122/40; 219/275; 219/302

[58] Field of Search ..... 219/296, 302–305, 308, 271–276; 122/40

[56] References Cited

U.S. PATENT DOCUMENTS

| | | | |
|---|---|---|---|
| 220,712 | 10/1879 | Everding | 122/40 |
| 1,475,589 | 11/1923 | Marden | 219/273 X |
| 2,097,581 | 11/1937 | Beyrodt | 219/302 |
| 2,576,976 | 12/1951 | Stagner | 219/273 |
| 2,606,272 | 8/1952 | Platt | 219/273 |
| 2,615,215 | 10/1952 | Stagner | 219/273 X |

FOREIGN PATENT DOCUMENTS

| | | | |
|---|---|---|---|
| 2306400 | 10/1976 | France | 219/273 |

*Primary Examiner*—A. Bartis

*Attorney, Agent, or Firm*—LeBlanc, Nolan, Shur & Nies

[57] ABSTRACT

A steam generator intended for intermittent operation has a cylindrical body in which a water-conducting passageway and hollow spaces for electric resistance elements are located. The cylindrical body is homogenous, and the water conducting passageway is located axially and symmetrically. From that passageway one or more radial passageways extend out of the body. The cylindrical body is externally provided with the heat insulating material, which in turn is enclosed in a casing of a material, at least the inner surface of which is reflective. An atomizer nozzle is located within the water conducting passageway, and is arranged to atomize water against substantially the entire wall surface of the passageway. The insulating material surrounds the body and has a thickness which is about equal to the radius of the cylindrical body. The insulating material and casing together maintain the body at a standby temperature of at least 70° C. when the resistance elements are deenergized between the intermittent periods of steam generation and the resistance elements when reenergized heat the body to steam generating temperature from the standby temperature in about 30 seconds.

3 Claims, 3 Drawing Figures

ELECTRICAL STEAM GENERATOR FOR INTERMITTENT OPERATION

This invention relates to a steam generator intended to generate steam, for example, for dish washers in hospitals and industrial premises.

At dish washers, for which high temperatures are desired, steam is used by injecting it into the device in question.

The present invention primarily relates to small-size dish washers and disinfection apparatuses of the type used, for example, in nursing departments in hospitals.

One problem with known steam generators for this purpose lies in their intermittent operation. After having been in use, a period of several hours may pass before it is used again.

At present, therefore, maintenance heat is used for holding hot water available all the time. According to calculations, of the energy consumption for a water heater for said purpose up to about 60% is used for maintaining water hot during periods in which hot water is not in demand.

The reason why water is maintained hot is because it takes an unacceptably long time to heat water from room temperature until the necessary amount of hot water at the required temperature is produced.

The present invention solves the aforesaid problem.

The present invention, thus, relates to a steam generator, which is intended for intermittent use, and which comprises a body, in which a water-conducting passageway and hollow spaces for electric resistance elements are located, and which is characterized, in that the body is cylindrical and homogenous, that said passageway is located axially and symetrically, and one or more radial passageways extend therefrom out of the body, and that the body externally is provided with a heat insulating material, which is enclosed in a casing of a material, of which at least its inner surface is reflective.

Figure 1:
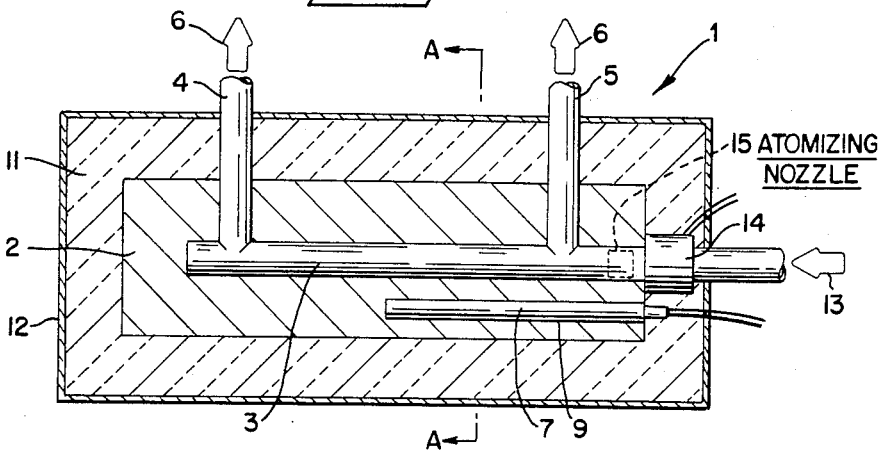
Figure 2:
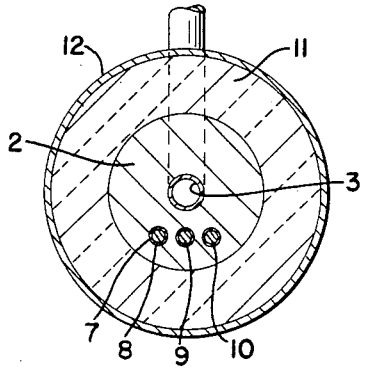
Figure 3:
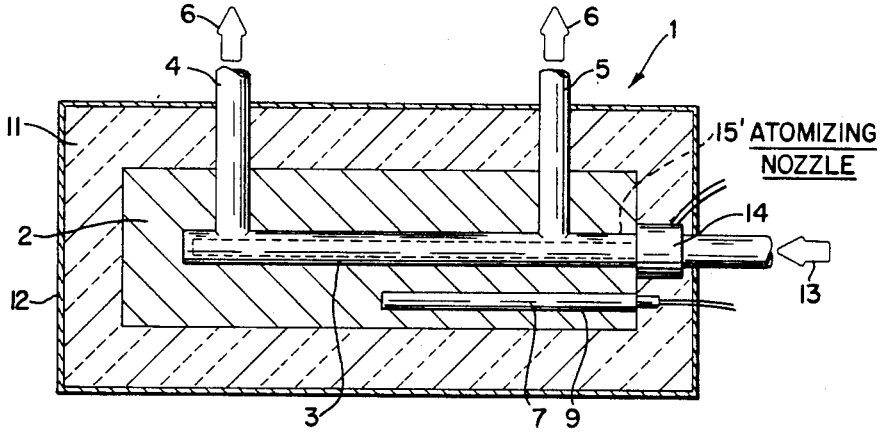

The invention is described in greater detail in the following, with reference to the accompanying drawing, in which an embodiment of the invention is shown by way of example, and in which FIG. 1 is a longitudinal section of a steam generator according to the invention, FIG. 2 is a cross-section along the line A—A in FIG. 1, and FIG. 3 illustrates a further embodiment of the steam generator shown in FIG. 1.

In FIG. 1 a steam generator according to the invention is given the general designation 1 and comprises a body 2 with a water-conducting passageway 3 extending axially therein. One or more radial passageways 4,5 are provided to conduct steam out of said body 1 as indicated by the arrows 6.

Electric resistance elements 7 of cylindrical shape are inserted in expedient hollow spaces 8,9,10 in the body 1, which hollow spaces are located in parallel with the axial passageway 3. Said body 1 is homogeneous and made of a material with good thermal conductivity, preferably aluminium.

The body 1 is externally provided with a heat insulating material 11, which is enclosed in a casing 12 of a material, at least the inner surface of which is reflective. According to a preferred embodiment, the heat insulating material is mineral wool. The casing 12, according to a preferred embodiment, is made of aluminium sheet metal.

The heat insulating material has a substantial thickness, i.e. of the same magnitude as the radius of the body 1.

The steam generator operates as follows.

The body 1 is heated by means of the resistance elements 7 to a temperature above the steam-forming temperature for water, for example 120° C.-200° C., but temperatures even up to 300° C. can be of interest. When the body has assumed a temperature of about 160° C., cold water is led into the passageway 3, as indicated by arrow 13, by action of a solenoid valve 14, which also can act as a check valve. The water is atomized via a nozzle 15 and a lime filter and flows out as steam through the passageways 4,5.

The nozzle 15 is provided to atomize the water before its vaporization.

According to a preferred embodiment, the device for atomizing the water consists of a nozzle 15' which extends along at least the greater part of the length of the passageway 3 and sprays atomized water against the walls of the passageway 3. The extended nozzle 15' according to one embodiment comprises a pipe coaxial with the passageway 3 and provided with a great number of small apertures in its shell surface distributed along the entire length of the pipe. The number of apertures and their location are adjusted so that the water is distributed uniformly against the walls of passageway 3. The apertures have a small diameter, preferably below 1 mm, whereby each aperture atomizes the water penetrating outward therethrough. The pipe is located radially spaced from the walls of passageway 3. The outer diameter of the pipe, of course, is smaller than the inner diameter of the passageway 3 and can be about half said diameter. The extended nozzle 15' is connected to the passageway 3 in the same way as the nozzle 15 shown. As a result thereof, the greater part or all of the walls of the passageway 3 is met by atomized water, which is instantaneously vaporized. Therefore, between the extended nozzle 15' and the passageway wall water in liquid state is present only to a very small extent or not at all.

The length of the body may be, for example, 400 mm, its diameter 120 mm, and the insulation layer may have a thickness of 50 mm.

The body, at such an embodiment, can be heated from room temperature to a temperature of 300° C. in about 30 minutes by choosing a suitable effect of the resistance elements. When the body has been heated to a temperature of 120° C. to 160° C., the body cools during a normal working day, without energy supply, only to 70° C. to 80° C., owing to the heat insulating material 11 and casing 12.

The great advantage is to be seen in the fact that the body is maintained relatively warm, although the resistance elements 7 are not switched on. This implies, that the body can be heated from 70° C. to 120°-160° C. in about 30 seconds and thereby produce steam.

These properties are utilized in such a way, that the body is heated at the beginning of a working day, for example, to 300° C., and the resistance elements are then switched off. When thereafter steam is desired, the resistance elements must be switched on only for a short period, for example 30 seconds, in order to obtain steam. The steam generator according to the present invention is thus extremely well suitable for intermittent use, especially for the purposes referred to above in the introductory portion, because it requires additional energy supply substantially only during the steam production periods.

The steam generator, of course, can be designed in a way different of that shown at the above embodiment.

The invention, thus, must not be regarded restricted to this embodiment, but can be varied within the scope defined in the attached claims.

I claim:

1. A steam generator intended for intermittent operation, consisting of a body (1), in which a water conducting passageway (3) and hollow spaces (8,9,10) and intermittently energizable electric resistance elements (7) in said hollow spaces are located, which body (1) is cylindrical and homogenous with said passageway (3) axially and symmetrically positioned therein, from which passageway at least one radial outlet passageway (4,5) extends out of the body (1), characterized in that the body (1) externally is provided with a heat insulating material (11), the thickness of which is about the same magnitude as the radius of said body (1), which material is enclosed in a casing (12) made of a material, at least the inner surface of which is reflective, said insulating material and said casing together being capable of maintaining said body at a standby temperature of at least 70° C. when said resistance elements are deenergized between intermittent periods of steam generation, said resistance elements being capable when reenergized of heating said body to a steam generating temperature from said standby temperature in about 30 seconds, and in that an atomizing nozzle is provided for introducing water into said water conducting passageway consisting of a pipe located in the water conducting passageway (3) along at least the greater part of the length of the water conducting passageway (3) and radially spaced from the walls of the water conducting passageway (3), said pipe being provided with a plurality of small apertures distributed along the entire length of said pipe for effecting a uniform spray of atomized water against substantially all of the water conducting passageway walls.

2. A steam generator as defined in claim 1, characterized in that the heat insulating material (7), which is mineral wool, is enclosed in a casing (12) of aluminium sheet metal.

3. A steam generator as defined in claim 1, characterized in that said electric resistance elements (7) are cylindrical and located respectively in said hollow spaces (8, 9, 10), which are disposed parallel with said axial water-conducting passageway (3).

* * * * *